US007375630B2

(12) United States Patent
Babich et al.

(10) Patent No.: US 7,375,630 B2
(45) Date of Patent: May 20, 2008

(54) DUAL TECHNOLOGY SENSOR DEVICE WITH RANGE GATED SENSITIVITY

(75) Inventors: Thomas S Babich, Glen Cove, NY (US); Christopher D Martin, Plainview, NY (US)

(73) Assignee: Honeywell International Inc., Morristown, NJ (US)

( * ) Notice: Subject to any disclaimer, the term of this patent is extended or adjusted under 35 U.S.C. 154(b) by 255 days.

(21) Appl. No.: 11/342,046

(22) Filed: Jan. 27, 2006

(65) Prior Publication Data

US 2007/0176765 A1 Aug. 2, 2007

(51) Int. Cl.
*G08B 13/18* (2006.01)

(52) U.S. Cl. ..... 340/567; 340/554; 340/567

(58) Field of Classification Search ..... 340/554, 340/548.3, 552, 506, 541, 567, 573
See application file for complete search history.

(56) References Cited

U.S. PATENT DOCUMENTS 5,473,368 A 12/1995 Hart
5,986,357 A * 11/1999 Myron et al. ..... 307/116
6,188,318 B1 * 2/2001 Katz et al. ..... 340/545.3
6,239,736 B1 5/2001 McDonald et al.
6,661,345 B1 * 12/2003 Bevan et al. ..... 340/575
7,126,476 B2 * 10/2006 Alkelai et al. ..... 340/565
2002/0175815 A1 * 11/2002 Baldwin ..... 340/567
2005/0024208 A1 * 2/2005 Maki et al. ..... 340/545.3
2006/0006882 A1 * 1/2006 Tsuji ..... 324/644

FOREIGN PATENT DOCUMENTS

EP 0581 569 A1 2/1994
WO WO 9743741 * 5/1997
WO WO 97/43741 11/1997

OTHER PUBLICATIONS

RCR-90: GE Motion Sensors, Jan. 24, 2007.*
GE Motion Sensors—PrecisionLine Dual Technology Motion Sensor RCR90 Jan. 27, 2004.

* cited by examiner

*Primary Examiner*—Davetta W. Goins
*Assistant Examiner*—Edny Labbees
(74) *Attorney, Agent, or Firm*—Anthony R. Barkume, P.C.

(57) ABSTRACT

A method and device for detecting an intruder in a region with increased performance and decreased false alarms. The security device has a microwave sensor and a PIR sensor operatively coupled to a processor. To increase the performance of the security device the device determines distance information of an object in the region with the microwave sensor, processes the distance information to adapt a frequency response of the PIR sensor to provide a frequency adapted PIR signal, and determines if the object is an intruder by using the frequency adapted PIR signal.

22 Claims, 5 Drawing Sheets

DUAL TECHNOLOGY SENSOR DEVICE WITH RANGE GATED SENSITIVITY

TECHNICAL FIELD

This invention relates to security systems, and in particular to a security device that uses a microwave detector for range determination to improve the performance of a PIR detector.

BACKGROUND ART

Security systems often employ the use of passive infrared (PIR) sensors for detecting motion in a region. A PIR sensor comprises a lens array that divides the protected region into sectors, a PIR detector that detects from each sector heat radiating from an object, and an amplifier/threshold detection circuit for determining if the detected heat is above a threshold producing an alarm condition. As an intruder passes through the protected region, the lens array collects and focuses the intruder's heat from each sector it passes through onto the PIR detector to produce a sine wave. The frequency of the sine wave corresponds to the speed of the intruder walking through the sectors, and the amplitude of the sine wave corresponds to the amount of heat collected by the lens array onto the detector. Additionally, because the lens array collects heat from finger-like cones that get larger as the distance from the sensor increases, the frequency and the amplitude of the sine wave are dependent on the distance of the intruder from the PIR sensor and the direction in which the intruder is traveling. If the intruder is close to the PIR sensor, the frequency and amplitude are much higher than if the intruder is on the far side of the region. The amplifier/threshold detection circuit must be designed to handle the wide range of frequencies and amplitudes produced by the extreme cases, i.e. slow walks at the far end of the region and fast walks at the close ends of the region. This causes the PIR sensor to be more susceptible to noise and false alarms.

A second problem with the PIR sensors occurs when the intruder walks directly at the PIR sensor (so-called "down the throat") rather than across the field and through the sectors of the lens array. In this case, the PIR may not detect the intruder.

An additional problem with PIR sensors is that they are designed to detect motion over a large region but are typically used in a much smaller region. This oversizing leaves the PIR sensor more vulnerable to false alarms. Typically, the PIR sensor is designed with a frequency response that balances the fast catch characteristics of up close motion with the slow catch performance needed at maximum distance. To get crisp catch in both cases leaves the unit very false alarm prone.

To alleviate the false alarm problems, dual-technology sensors have been designed that supplement PIR detectors with other detectors such as microwave detectors. The microwave detector and the PIR detector must both detect the intruder before an alarm condition is set. An alternative design is that the microwave detector output causes the threshold of the PIR threshold detection circuit to be adjusted. Both of these designs do not obviate the problem of down the throat detection because the PIR sensor will not produce a detectable signal.

It is therefore an object of the present invention to provide a security device that uses a PIR sensor and a microwave sensor for increased performance in detecting an intruder within a region without increased false alarms.

It is a further object of the present invention to provide a security device that uses the microwave sensor to determine the distance of an object within the region to adapt the frequency response of the PIR sensor for a crisp catch without higher false alarm sensitivity.

It is a further object of the present invention to provide a security device that detects an intruder walking directly towards or away from the sensor, or "down the throat".

It is a further object of the present invention to provide a security device that can detect motion in both a larger region and a smaller region without being prone to false alarms.

DISCLOSURE OF THE INVENTION

The present invention is a method and device for detecting an intruder in a region with increased performance and decreased false alarms. The security device has a microwave sensor and a PIR sensor operatively coupled to a processor. To increase the performance of the security device, the device determines distance information of an object in the region with the microwave sensor, processes the distance information to adapt the frequency response of the PIR sensor to provide a frequency adapted PIR signal, and determines if the object is an intruder by using the frequency adapted PIR signal.

The security device determines the distance information of an object in the region by transmitting a microwave pulse, receiving a microwave pulse reflected off of an object, determining the phase difference between the transmitted and received microwave pulses, and determining the distance of the object from the phase difference. The distance may also be determined in other ways such as measuring the time difference between the transmitted microwave pulse and the received microwave pulse.

The security device's processing circuitry processes the distance information to determine the desired frequency response of the PIR sensor and adapts the frequency response of the PIR sensor to correspond. This may be accomplished in the following manner. The processor inputs the distance information from the microwave sensor and selects the amplifier/filter parameters from stored filter parameters in memory, based on the distance information. If the filtering is performed digitally, the processing circuitry inputs the PIR signal from the PIR detector, stores the PIR signal, filters the PIR signal using the selected filter parameters, and generates the frequency adapted PIR signal. Digital filtering of the PIR signal is known in the art and is the preferred embodiment. One skilled in the art will recognize that the filtering may be performed by a parallel analog filter and analog switches.

The processing circuitry determines if the object is an intruder by using the frequency adapted PIR signal which is a more accurate representation of the object's motion and comprises less noise. The processing circuitry compares the frequency adapted PIR signal to a predetermined threshold, and if the frequency adapted PIR signal is above the predetermined threshold, the processing circuitry sets an intruder alert (such as by sending an alert signal to a centrally located control panel for further processing). An additional embodiment to further reduce false alarms and help with pet immunity is to change the predetermined threshold based on the distance information. The processing circuitry may perform this by storing a selection of predetermined thresholds and selecting which threshold is used based on the distance information received from the microwave sensor. For additional selections of stored thresholds, a pet immunity function may be enabled by an installer through selection of a jumper wire or programming means.

To alleviate the problem of down the throat intruder detection, the processing circuitry stores and updates the distance information of a detected object in the region and compares the distance information to a previously stored distance information to determine if the object is moving directly towards or away from the PIR sensor. If the processing circuitry determines this to be true, but the PIR sensor is not producing a detectable signal, the processing circuitry will set the intruder alert.

Lastly, to address the problem of using the PIR in a smaller room even though it is designed for a larger region, the processing circuitry determines if the distance information from the microwave sensor is greater than a predetermined distance, and if it is, then an intruder alert is not set even if the object is determined to be an intruder. The predetermined distance may be programmed during installation through wire jumpers or programming means. Additionally it may be necessary to provide exclusion areas within a large room where false alarms may be created by something in that area, such as a banner. In this case the processing circuitry determines if the distance information from the microwave sensor is within a predetermined zone, and if it is, then an intruder alert is not set. The predetermined zone may be programmed during installation through jumpers or programming means.

BEST MODE FOR CARRYING OUT THE INVENTION

Figure 1:
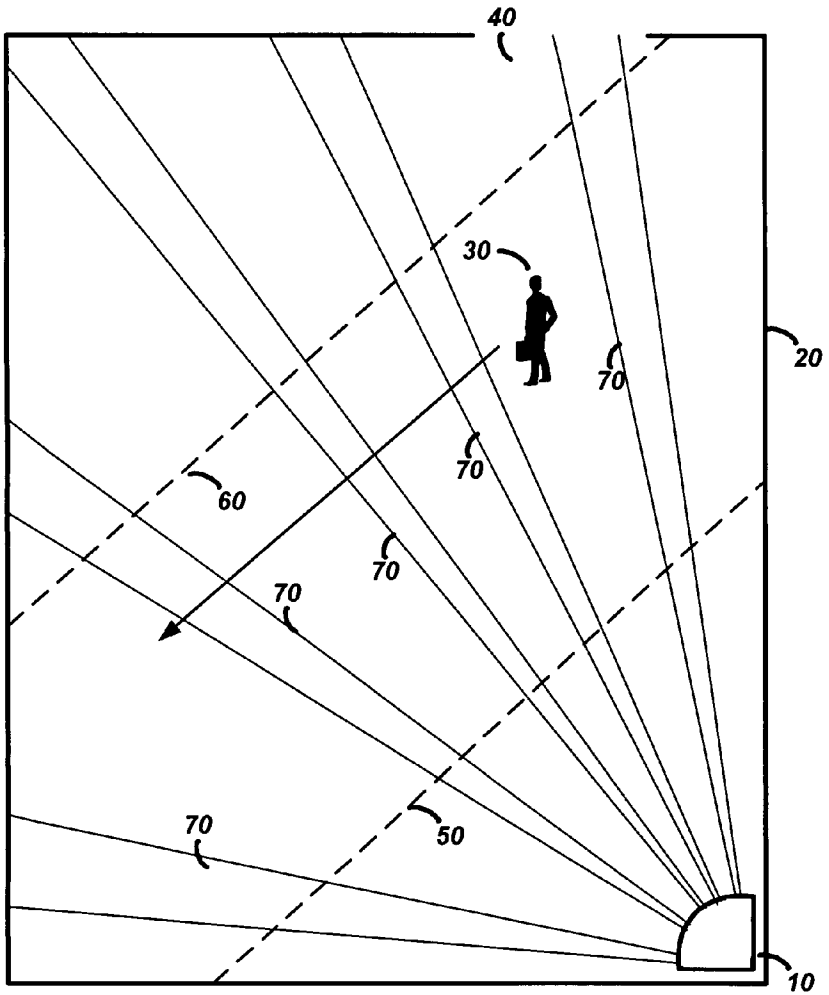
FIG. 1 is a diagram of the operation of the security device.
Figure 2:
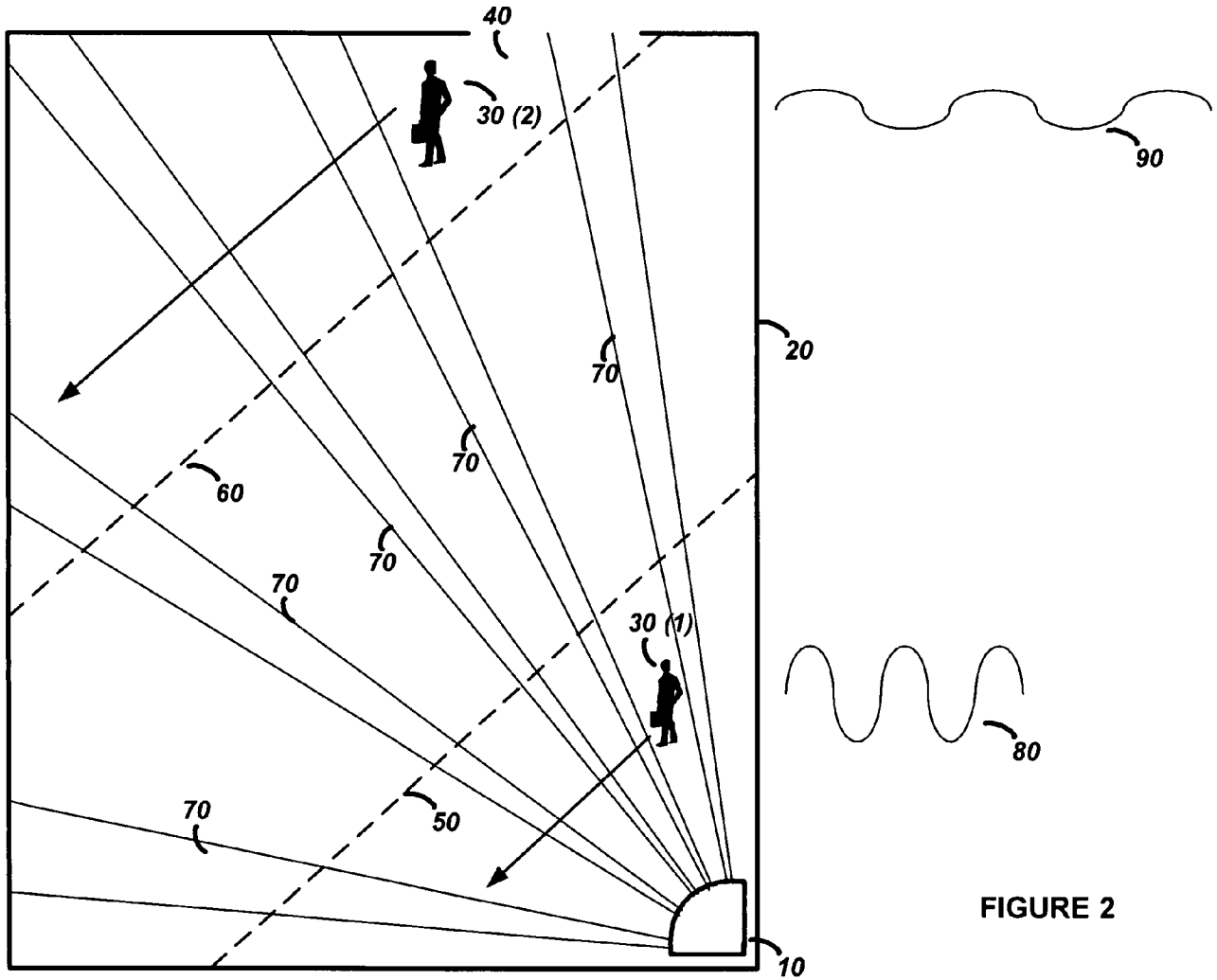
FIG. 2 is a diagram of an intruder walking across the lens sections of a PIR sensor.

The preferred embodiments of the present invention will now be described with respect to the Figures. FIG. 1 illustrates a block diagram of the operation of the security device 10 in a region 20. The security device 10 is programmed, through adjustment of jumpers by the installer, with the size of the region 20 during installation. When the security device 10 is armed, it protects the region 20 by transmitting microwave pulses through the region and collecting the pulses that are reflected back to the security device 10. As the intruder 30 walks into the region 20 through the entrance 40, he causes the reflected microwave pulses to change. The security device 10 senses the change and determines if the intruder 30 is less than 9 feet (shown by line 50), greater than 9 feet but less than 18 feet (shown by line 60), or greater than 18 feet from the security device 10. The calculation of the distance information is determined from the jumper information (during installation) and the phase difference between the transmitted pulse and the received pulse, and is well known to one skilled in the art. At the same time, the security device 10 is sensing the heat from the intruder 30 through its lens array. The collection fingers 70 of the lens array are shown to cover the entire region 20. The security device 10 uses the distance information from the microwave pulses to process the signal received through the lens array. As can be seen in FIG. 2, if the intruder 30(1) is close to the security device 10, the sensed signal 80 has a higher frequency and amplitude than the sensed signal 90 from the intruder 30(2) located further away from the security device 10. This distance information allows the security device 10 to process the sensed signals 80 and 90 more accurately, thereby allowing the intruder to be detected with more accuracy. To compound the issue, the intruder 30(1) may be running near the security device 10, or the intruder 30(2) may be walking slowly far from the security device 10.

Figure 3:
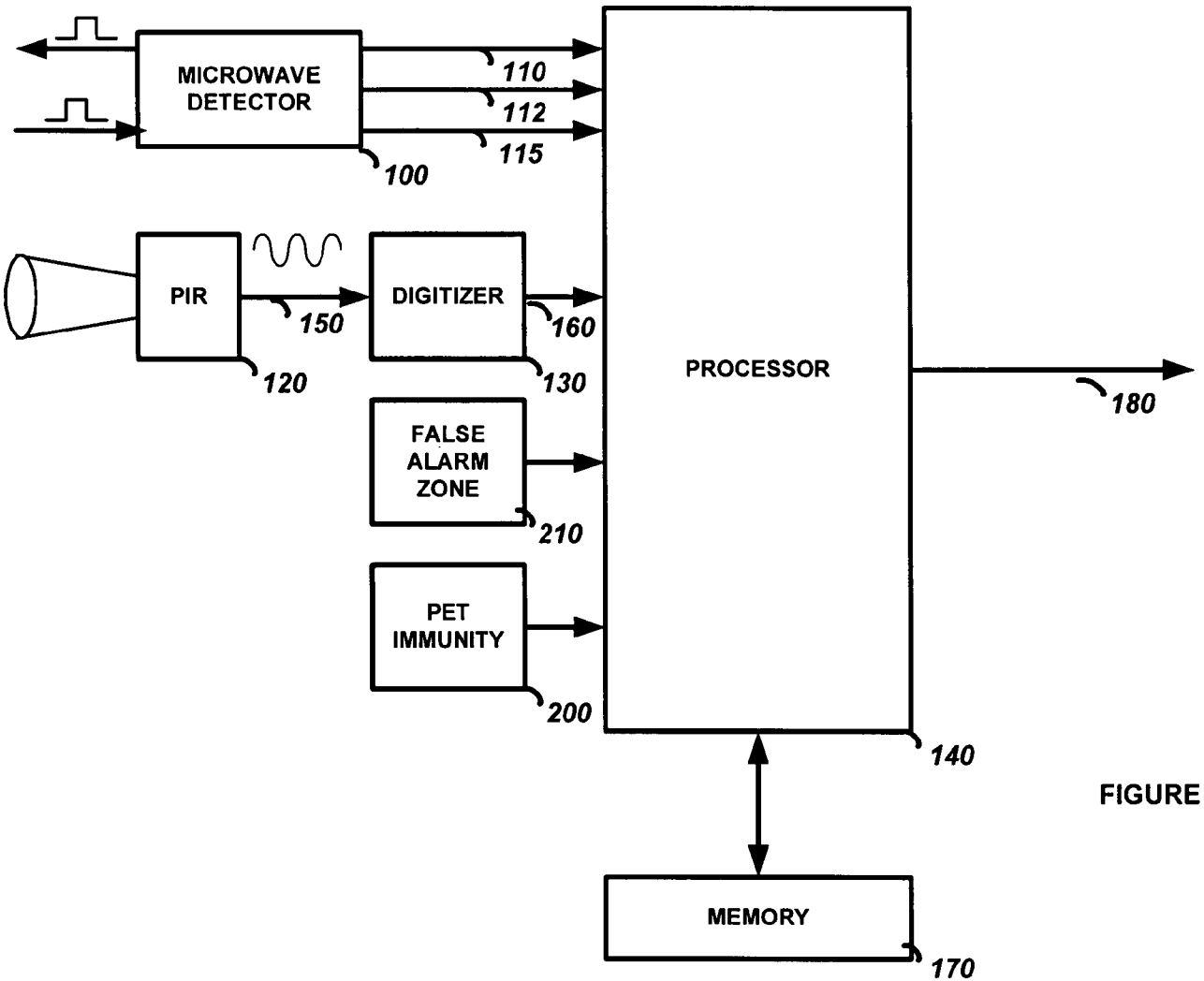
FIG. 3 is a block diagram of the security device.

FIG. 3 shows a block diagram of the security device 10. The microwave pulses are transmitted and received after reflection off an object by the microwave detector 100. The distance information 110, 112, and 115 is transmitted to the processor 140. When an intruder 30 is present in the region 20, the microwave detector 100 raises a flag (or signal) 110, 112, or 115 that corresponds to the distance of the intruder 30. The flag 110 corresponds to the intruder being detected as less than 9 feet from the security device 10, the flag 112 corresponds to the intruder being detected as greater than 9 feet but less than 18 feet from the security device 10, and the flag 115 corresponds to the intruder being detected as greater than 18 feet from the security device 10. As known in the art, a phase difference between a transmitted pulse and a received (echo) pulse is analyzed and a flag corresponding to the range of the object is generated. The processor 140 is continually accepting and storing digital data 160 from the digitizer 130. The digitizer 130 converts the signal 150 from the PIR sensor 120 into a digital format readable by the processor 140. When a flag 110, 112, or 115 interrupts the processor 140, the processor selects a corresponding digital filter from memory 170 based on which flag 110, 112, or 115 it has received, and then filters the stored digital data 160 with the selected digital filter. The resultant filtered signal is compared to a threshold also stored in memory and also selected based on the received flag 110, 112, or 115. If the resultant filtered signal is above the threshold, the alarm alert 180 is activated.

Also shown in FIG. 3 are the pet immunity function 200 and the false alarm zone 210 which are input to the processor 140 through jumpers or programming means by an installer. If the pet immunity function 200 has been enabled, the processor 140 compares the filtered signal to different thresholds stored in memory. These thresholds are higher levels in the ranges less than 18 feet to desensitize the PIR to ignore the signals created by a pet. The signals from distances greater than 18 feet are less likely to be created by a pet. If a false alarm zone 210 has been selected, for example for the range from 9 feet to 18 feet, the processor 140 will not activate the alarm alert 180 if flag 112 (which corresponds to that range) is activated. This allows an installer to exclude areas where false alarms are frequently created.

Figure 4:
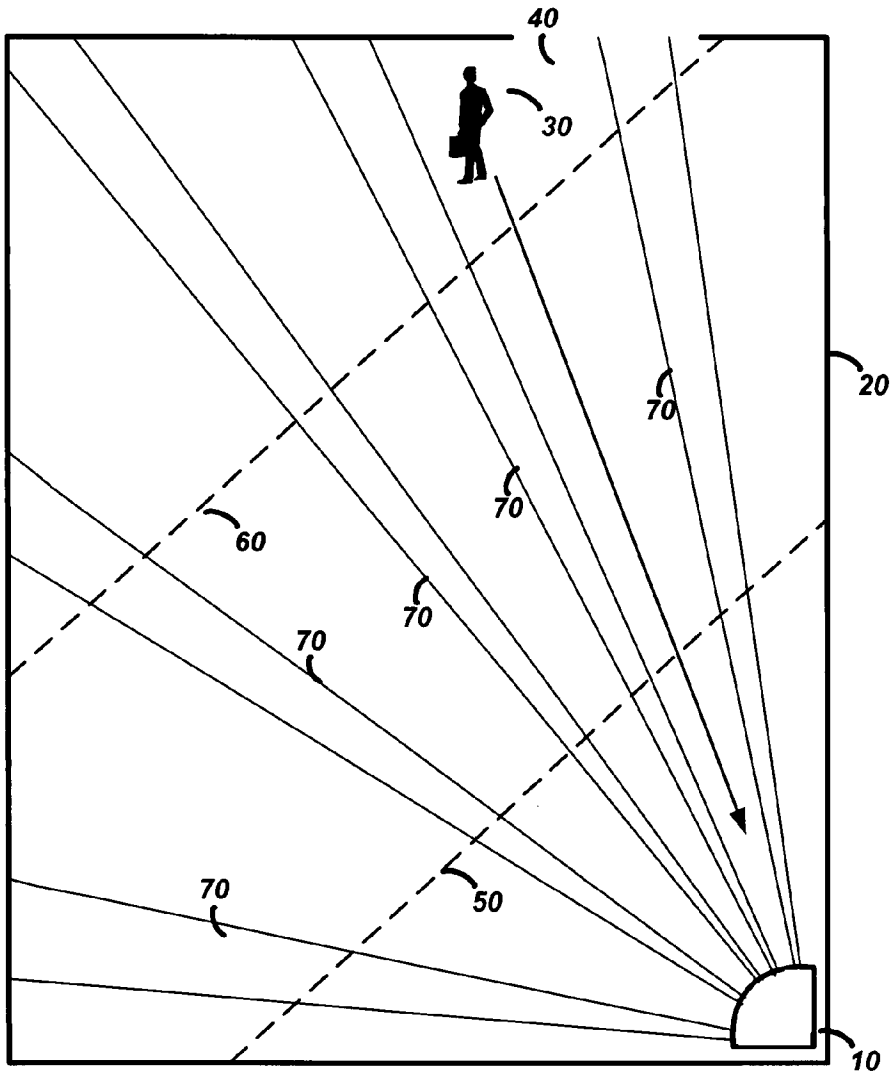
FIG. 4 is a diagram of an intruder walking down the throat of a PIR sensor.

FIG. 4 shows a common problem with PIR detectors 120, i.e. down the throat detection of the intruder 30. The intruder 30 may walk directly towards or away from the security device 10 between the fingers 70 of the lens array. In this situation, the sine waves a shown in FIG. 2 are not generated and the resultant filtered signal will not be above the threshold; as a result the alarm alert 180 will not be activated. The present invention addresses this problem by storing the distance information in memory 170. If the intruder 30 traverses from a far range to a closer range or from a closer range to a further range, for example over line 60 or over line 50, then the change in recorded distance information will indicate a moving intruder even though the PIR sensor has not detected a change in received heat. Thus, the alarm alert 180 will be activated regardless if the resultant filtered PIR signal is above the threshold. Note that this embodiment will determine if a moving object is traversing from one zone to another, but will not set an intruder alarm (which would likely be a false alarm) if the object moves only slightly (i.e. without traversing zones).

Figure 5:
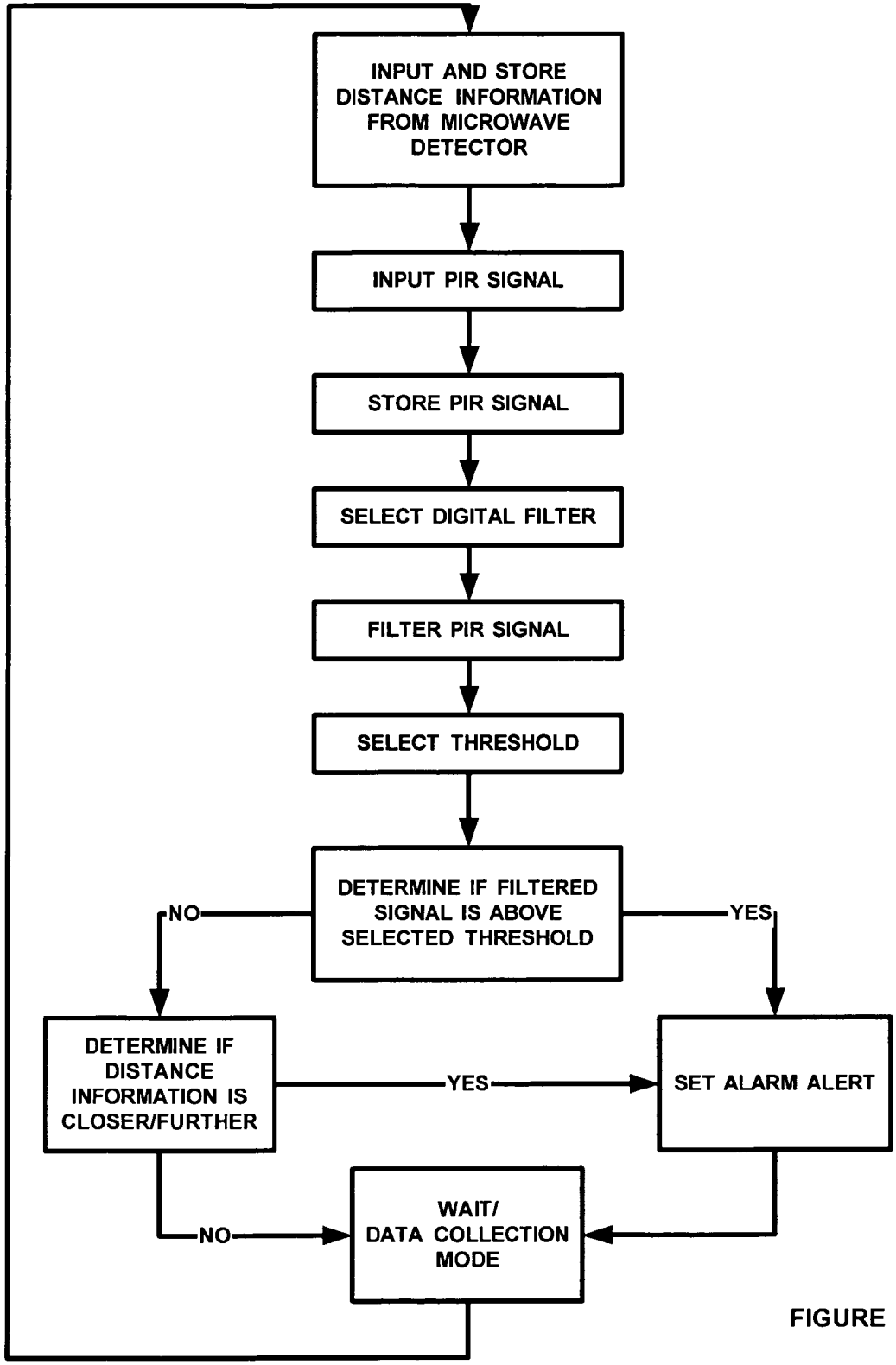
FIG. 5 is a flowchart of the present invention.

FIG. 5 shows a flow diagram of the operation of the security device 10. A flag 110, 112, or 115 from the microwave 100 causes the processor 140 to be interrupted from a wait/data collection mode. The processor 140 determines the distance information by determining which flag 110, 112, or 115 was raised. The distance information is then stored. The processor 140 selects the digital PIR data to be filtered. The digital PIR data is temporarily stored for digital filtering. The digital filter parameters are retrieved from memory 170 based on the distance information and the temporarily stored digital PIR data is filtered as well known in the art. A threshold is retrieved from memory 170 and the resultant filtered signal is compared to it. If the signal is greater than the threshold, the alarm alert 180 is activated. If the signal is not greater than the threshold, the distance information is checked against previously stored distance information to determine is the intruder 30 is closer to or further from the security device 10 indicating a down the throat condition. If the distance is closer or further, the alarm alert 180 is activated. Finally the processor goes into a wait/data collection mode until interrupted again.

It will be apparent to those skilled in the art that modifications to the specific embodiment described herein may be made while still being within the spirit and scope of the present invention. For example, the distance information may consist of more than three ranges, the ranges may be different sizes, or an actual distance information may be transmitted to the processor 140 from the microwave detector 100 rather than the three flags 110, 112, or 115. Also the distance information may be determined by measuring the time between the transmitted microwave pulse and the received microwave pulse. The size of the region 20 may be programmed differently than by the use of jumpers, and the information may be used by the processor to discriminate against distances out of range. Additionally, the digitizing may be performed internal to the processor, or there may be no digitizer and the filtering and the thresholding is performed using parallel analog circuits whose outputs are selected based on the distance information. Lastly, the processing flow may perform the same operations in a different order than described above.

What is claimed is:

1. A method of detecting an intruder in a region, with a security device having a microwave sensor and a PIR sensor operatively coupled to a processor, comprising the steps of:

a. determining distance information of an object in the region with the microwave sensor, b. processing the distance information to adapt a frequency response of the PIR sensor to provide a frequency adapted PIR signal, and c. determining if the object is an intruder by using the frequency adapted PIR signal.

2. The method of claim 1 wherein the step of determining the distance information of an object comprises the steps of:

a. transmitting a microwave pulse, b. receiving a microwave pulse, c. determining the phase difference between the transmitted and received microwave pulses, and d. determining a distance from the phase difference.

3. The method of claim 1 wherein the step of processing the distance information to adapt a frequency response of the PIR sensor to provide a frequency adapted PIR signal comprises the steps of:

a. inputting the distance information from the microwave sensor, b. selecting filter parameters from stored filter parameters in memory based on the distance information, c. inputting a PIR signal from the PIR sensor, d. storing the PIR signal, e. filtering the PIR signal using the selected filter parameters, and generating the frequency adapted signal.

4. The method of claim 1 wherein the step of determining if the object is an intruder by using the frequency adapted PIR signal comprises the steps of:

a. comparing the frequency adapted PIR signal to a predetermined threshold, and b. if the frequency adapted PIR signal is above the predetermined threshold, setting an intruder alert.

5. The method of claim 4 further comprising the step of adjusting the predetermined threshold based on the distance information.

6. The method of claim 5 wherein said security device further comprises a pet immunity function input and wherein the step of adjusting the predetermined threshold is based on the distance information and selection of the pet immunity function input.

7. The method of claim 4 further comprising the steps of:

c. comparing the distance information to a previous distance information, and d. if the distance information is less than the previous distance information then setting an intruder alert.

8. The method of claim 4 further comprising the steps of:

c. comparing the distance information to a previous distance information, and d. if the distance information is greater than the previous distance information then setting an intruder alert.

9. The method of claim 1 further comprising the step of:

d. determining if the distance is greater than a predetermined distance, and e. if the distance is greater than a predetermined distance, not setting an intruder alert if the object is determined to be an intruder.

10. The method of claim 1, wherein said security device further comprises a false alarm zone input, further comprising the steps of:

d. determining if the distance is in the false alarm zone, and e. if the distance is in the false alarm zone, not setting an intruder alert.

11. A security device for detecting an intruder in a region comprising:

a. a microwave sensor for providing a microwave signal, b. a PIR sensor for providing a PIR signal, and c. processing circuitry, said processing circuitry operatively coupled to said microwave sensor and said PIR sensor, adapted to:

i. determine distance information of an object in the region using said microwave signal, ii. process the distance information to adapt a frequency response of the PIR sensor to provide a frequency adapted PIR signal, and iii. determine if the object is an intruder by using the frequency adapted PIR signal.

12. The security device of claim 11 wherein the processing circuitry for processing the distance information to adapt a frequency response of the PIR sensor is further adapted to:

a. select a filter based on said distance information, and b. filter said PIR signal with said filter to provide a frequency adapted PIR signal.

13. The security device of claim 11 wherein the microwave sensor is adapted to:

a. transmit a microwave pulse, b. receive a microwave pulse, and c. generate a phase signal representative of the time between the transmitted microwave pulse and the received microwave pulse.

14. The security device of claim 13 wherein the processing circuitry determines the distance information of an object in the region using said phase signal.

15. The security device of claim 12 wherein the processing circuitry comprises a digital filter for filtering said PIR signal.

16. The security device of claim 12 wherein the processing circuitry comprises an analog filter for filtering said PIR signal.

17. The security device of claim 11 wherein the processing circuitry comprises a threshold detection circuit for comparing said frequency adapted PIR signal against a predetermined threshold.

18. The security device of claim 17 wherein the processing circuitry changes the predetermined threshold based on the distance information.

19. The security device of claim 17 further comprising a pet immunity function input and wherein the processing circuitry changes the predetermined threshold based on the distance information and selection of the pet immunity function input.

20. The security device of claim 17 wherein the processing circuitry stores and updates the distance information of an object in the region and compares the distance information to a previously stored distance information to determine if the object is moving directly towards or away the PIR sensor thereby allowing an intruder to be detected if the frequency adapted PIR signal is not greater than the predetermined threshold because the PIR sensor can not sense down the throat movement.

21. The security device of claim 11 wherein the processing circuitry determines if the distance is greater than a predetermined distance and if it is then not setting an intruder alert if the object is determined to be an intruder.

22. The security device of claim 11 further comprising a false alarm zone input and wherein the processing circuitry determines if the distance is within the false alarm zone than not setting an intruder alert.

* * * * *